US009528773B2

(12) United States Patent
Otahal et al.

(10) Patent No.: US 9,528,773 B2
(45) Date of Patent: Dec. 27, 2016

(54) PLATE HEAT EXCHANGER HAVING A PLURALITY OF PLATES STACKED ONE UPON THE OTHER

(75) Inventors: Klaus Otahal, St. Florian (AT); Niki Hawa, Linz (AT)

(73) Assignee: Mahle International GmbH (DE)

( * ) Notice: Subject to any disclaimer, the term of this patent is extended or adjusted under 35 U.S.C. 154(b) by 965 days.

(21) Appl. No.: 13/383,924

(22) PCT Filed: Jul. 8, 2010

(86) PCT No.: PCT/EP2010/059800

§ 371 (c)(1),
(2), (4) Date: Mar. 30, 2012

(87) PCT Pub. No.: WO2011/006825

PCT Pub. Date: Jan. 20, 2011

(65) Prior Publication Data

US 2012/0175092 A1 Jul. 12, 2012

(30) Foreign Application Priority Data

Jul. 16, 2009 (AT) ..... A 1117/2009

(51) Int. Cl.
*F28F 3/00* (2006.01)
*F28F 3/08* (2006.01)
(Continued)

(52) U.S. Cl.
CPC ..... *F28D 9/005* (2013.01); *F28F 9/02* (2013.01); *F28D 2021/0089* (2013.01);
(Continued)

(58) Field of Classification Search
CPC ..... F28D 9/0037; F28D 9/0062; F28D 9/005; F28F 3/083
(Continued)

(56) References Cited

U.S. PATENT DOCUMENTS 5,927,394 A * 7/1999 Mendler ..... F16N 39/02 165/166
2004/0040697 A1* 3/2004 Pierre ..... F28D 9/0043 165/166
(Continued)

FOREIGN PATENT DOCUMENTS

CN 101256057 A 9/2008
DE 19711258 A1 9/1998
(Continued)

OTHER PUBLICATIONS

English abstract for CN-101256057.
Chinese Office Action for CN201080031959.1, dated Aug. 15, 2013.
(Continued)

*Primary Examiner* — Len Tran
*Assistant Examiner* — Claire Rojohn, III
(74) *Attorney, Agent, or Firm* — Fishman Stewart PLLC

(57) ABSTRACT

A plate heat exchanger may include a plurality of plates stacked one upon each other forming a stack. Each plate may alternately span a first and a second flow space forming a first and second medium respectively. Each plate may have a circumferential edge and a basin-shaped design. Two adjacent plates may be connected to each other via the circumferential edges. An end plate may be connected to at least one adjacent plate at least one end of the stack, wherein the circumferential edge of the at least on adjacent plate is supported on the end plate by a wall face of the end plate. The edge of the at least one adjacent plate may be formed parallel and fixedly connected to the wall face. The end plate may include an aluminium alloy, wherein the wall face is formed between two flat, generally parallel surfaces of the end plate.

18 Claims, 7 Drawing Sheets

(51) Int. Cl.
*F28D 9/00* (2006.01)
*F28F 9/02* (2006.01)
*F28D 21/00* (2006.01)

(52) U.S. Cl.
CPC ..... *F28F 2225/04* (2013.01); *F28F 2275/04* (2013.01); *F28F 2280/06* (2013.01)

(58) Field of Classification Search
USPC ..... 165/109.1, 166, 167
See application file for complete search history.

(56) References Cited

U.S. PATENT DOCUMENTS

| | | | | |
|---|---|---|---|---|
| 2006/0243429 | A1* | 11/2006 | Chu et al. | 165/109.1 |
| 2007/0084809 | A1* | 4/2007 | Bradu | F28D 9/005 211/59.4 |
| 2007/0289724 | A1* | 12/2007 | Hoof | F28D 9/005 165/149 |
| 2008/0257536 | A1* | 10/2008 | Kolblin et al. | 165/167 |
| 2011/0024095 | A1* | 2/2011 | Kozdras | F28D 9/005 165/167 |

FOREIGN PATENT DOCUMENTS

| | | | |
|---|---|---|---|
| DE | 102004003790 | A1 | 8/2005 |
| DE | 102007030563 | A1 | 1/2009 |
| EP | 0623798 | A2 | 11/1994 |
| EP | 1772693 | A1 | 4/2007 |
| EP | 1855074 | A2 | 11/2007 |
| JP | S61-150405 | A | 7/1986 |
| JP | 10185462 | A | 7/1998 |
| JP | H10-246595 | A | 9/1998 |
| JP | 2004-346916 | A | 12/2004 |
| JP | 2005-530979 | A | 10/2005 |
| JP | 2007-518958 | A | 7/2007 |
| JP | 2009-501892 | A | 1/2009 |
| WO | WO-2005071342 | A1 | 8/2005 |
| WO | WO-2007038871 | A1 | 4/2007 |

OTHER PUBLICATIONS

Translated JP Office Action dated Mar. 18, 2014.
English abstract for EP-0623798.
English abstract for DE-102007030563.
English abstract for JP-10185462.
English abstract for EP-1772693.

* cited by examiner

PLATE HEAT EXCHANGER HAVING A PLURALITY OF PLATES STACKED ONE UPON THE OTHER

CROSS-REFERENCES TO RELATED APPLICATION

This application claims priority to German Patent Applications A1117/2009 filed on Jun. 16, 2009 and PCT/EP2010/059800 filed on Jul. 8, 2010, which are hereby incorporated by reference in their entireties.

TECHNICAL FIELD

The invention relates to a plate heat exchanger having a plurality of plates stacked one upon the other, which each alternately span a first and a second flow space for a first and second medium respectively, wherein each plate has a circumferential edge and has an essentially basin-shaped design, and wherein two adjacent plates are in each case connected to each other via the circumferential edges, and wherein an end plate is fixedly connected to at least one adjacent plate at at least one end of the stack, wherein the circumferential edge of the adjacent plate is supported on the end plate by means of a wall face formed parallel to the said edge and is fixedly connected to the said wall face.

BACKGROUND

EP 0 623 798 A2 describes a plate heat exchanger having basin-shaped heat exchanger plates stacked one upon the other, the circumferential edges of which bear against each other and are soldered to each other in a leakproof manner, wherein all the heat exchanger plates have the same shape. In such designs, the lowest basin-shaped plate which is attached to the end plate forms the weakest member with regard to strength. The notch which arises in conventional structures between the lower basin-shaped plate and the end plate is particular unfavourable in terms of strength and the introduction of forces.

Oil coolers of this type are generally fastened at the end plate to the engine block or to modules close to the engine by means of screw-fastenings and are therefore subject to high transverse acceleration forces due to the engine vibrations during operation of the engine. A generally more important load results from the pulsing oil pressure in the lubrication system. This acts both from the inside in the individual oil sites and from below on the connecting plate. The module or engine housing opposite is usually configured at the interface with relatively long, open oil ducts which are closed by means of a contoured seal and the heat exchanger end plate. The heat exchanger connecting plate is loaded to bending by the prestress of the seal and in particular by the increasing oil pressure in the connecting ducts.

Plate heat exchangers of the above-mentioned type do not generally withstand such loads; the above-mentioned notch is often the starting point for cracks in the lowest oil plate or in the solder. The result is leaking and loss of media.

DE 197 11 258 C2 discloses a plate heat exchanger for a motor vehicle engine which consists of a plurality of basin-shaped plates which are stacked in a spaced apart manner and soldered to form adjacent hollow chambers with their upright edges lying inside each other, with the lowest plate being attached to an end plate. In order to meet strength requirements for mounting directly on the engine block, a reinforcement plate is also arranged between the end plate and the lowest plate, which reinforcement plate is provided with a border which encloses the edge of the lowest plate. The reinforcement plate is soldered to the lowest plate.

WO 2007/038871 A1 describes a plate heat exchanger having an end plate and a stack of basin-shaped plates, the lowest plate resting over its entire area on the end plate. The lowest plate is surrounded by a circumferential reinforcement frame.

If these reinforcement measures are not sufficient, the end plate, which is usually configured as a punched sheet metal part, is dimensioned to be correspondingly stronger, which however increases the space requirement, weight and costs.

SUMMARY

The object of the invention is to meet strength requirements in a plate heat exchanger of the type mentioned in the introduction without essentially increasing the total installation height or amount of materials used.

According to the invention, this is achieved in that the end plate consists of an aluminium alloy, wherein the wall face is preferably formed between two essentially flat, parallel surfaces of the end plate.

According to a first variant of the invention, the wall face can be formed by an inner lateral face of an essentially basin-shaped receptacle in the end plate for the adjacent plate. The particular advantage of this is that the end plate forms a mounting plate of the plate heat exchanger. In this case parts are saved if the receptacle is at least partially formed by a depression formed in the end plate. Alternatively, it can be provided for the end plate to consist of an essentially flat plate part and a frame part which is connected preferably non-detachably to the plate part, wherein the receptacle can be at least partially formed by the frame part.

The depth of the receptacle should correspond essentially to at least the height of the edge of the adjacent plate.

A further advantageous variant of the invention provides for the wall face to be formed by an outer lateral face of the end plate. The particular advantage of this is that the end plate forms a cover plate of the plate heat exchanger.

In order to achieve a particularly good connection between the adjacent plate and the end plate, it is provided for the adjacent plate to be at least for the most part in contact with the end plate with the face facing the end plate, wherein the end plate is preferably soldered to the adjacent plate.

Thanks to the shaping steps described, the above-described notch is avoided and the flow of force can be distributed starting from the screw-fastening points over a much larger transition area to the plates of the plate heat exchanger. The modulus of resistance of the entire heat exchanger is likewise considerably increased. This is clearly shown in finite element strength calculations. In order to achieve high strength while using a low amount of material, the end plate can have at least some cut-out portions, preferably honeycomb structures, on the side facing away from the adjacent plate in order to reduce the weight. As this 3-dimensional shape cannot be formed by a conventional punched part, other production methods must be used. Suitable production methods for this are for instance:

- specific aluminium casting methods such as thixocasting or Vacural die casting, in which solderable alloys can be processed,
- shaping methods such as forging or extrusion,
- sintering methods, where applicable for suitable alloys,
- mechanical machining, if economically reasonable (for prototypes).

The necessary openings, such as feed or discharge openings for the first or second coolant, can be cast in the end plate.

BRIEF DESCRIPTION OF THE DRAWINGS

In the figures.

DETAILED DESCRIPTION

Figure 1:
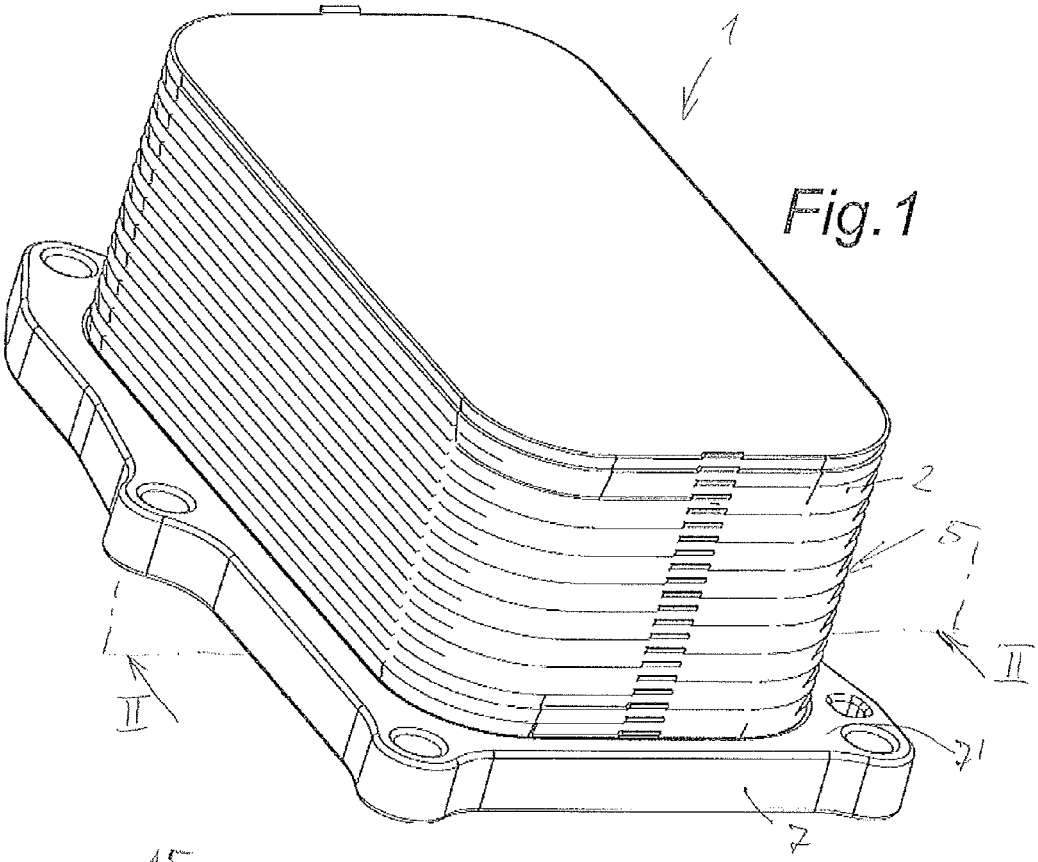
FIG. 1 shows a plate heat exchanger according to the invention in an oblique view in a first variant.
Figure 2:
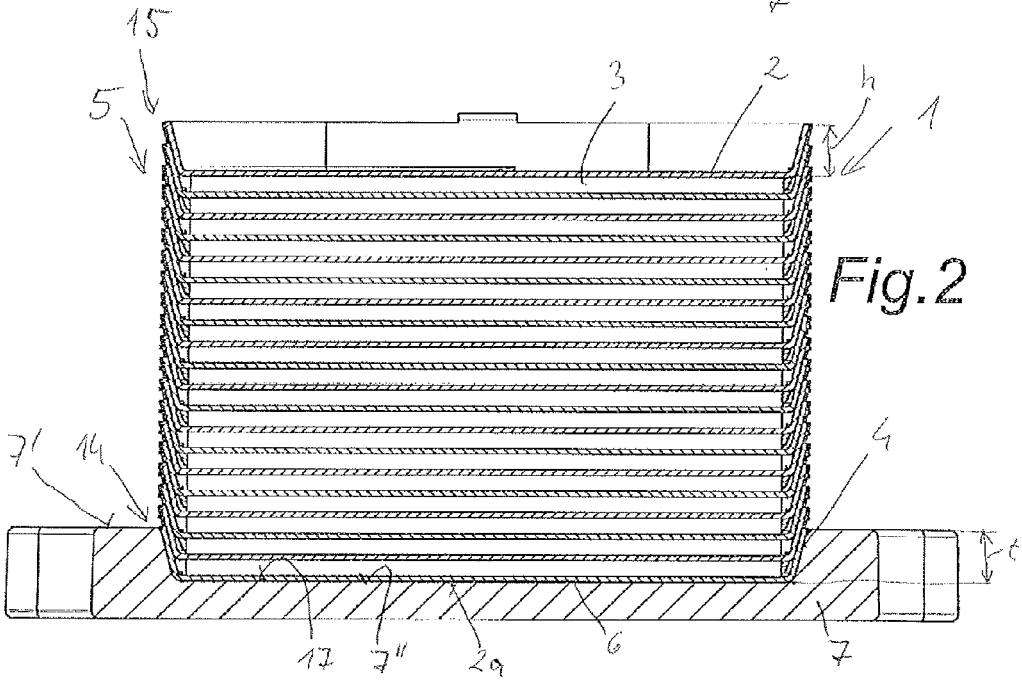
FIG. 2 shows the plate heat exchanger in section along line II-II in FIG. 1.

FIGS. 1 and 2 show a plate heat exchanger 1 having a number of basin-shaped plates 2 stacked one upon the other, wherein a flow space 3 for a first or second medium is formed between the two adjacent plates 2. The edges 4 of two adjacent plates 2 are soldered to each other.

An end plate 7 consisting of an aluminium alloy is arranged in the region of the lowest plate 2 of the stack 5 in the region of the side 6 facing away from the edge 4.

The end plate 7 is connected fixedly to at least one adjacent plate 2 at the lower end 14 of the stack 5, wherein the circumferential edge 4 of the adjacent plate 2 is supported on a wall face 19 of the end plate 7 formed parallel to the said edge 4 and is connected fixedly to the said wall face 19. The wall face 19 is formed between flat, parallel surfaces 7', 7" of the end plate 7. In the exemplary embodiment shown in FIGS. 1 to 4, the wall face 19 is formed by an inner lateral face 16 of an essentially basin-like receptacle 17 in the end plate 7 for the adjacent plate 2, wherein the receptacle 17 is configured as a depression 18 formed in the end plate 7, which depression essentially has the same shape as the lowest plate 2. The end plate 7 with the depression 8 can for example be produced by a thixocasting method. The depth t of the depression 8 corresponds essentially to at least the height h of the edge 4 of a plate 2.

In the exemplary embodiment, the lowest plate 2 is included in the whole of the depression 8, wherein the face 2*a* of the plate 2 facing the end plate 7 rests over its entire area against the end plate 7. The entire face 2*a* of the plate 2 is soldered to the end plate 7.

Figure 3:
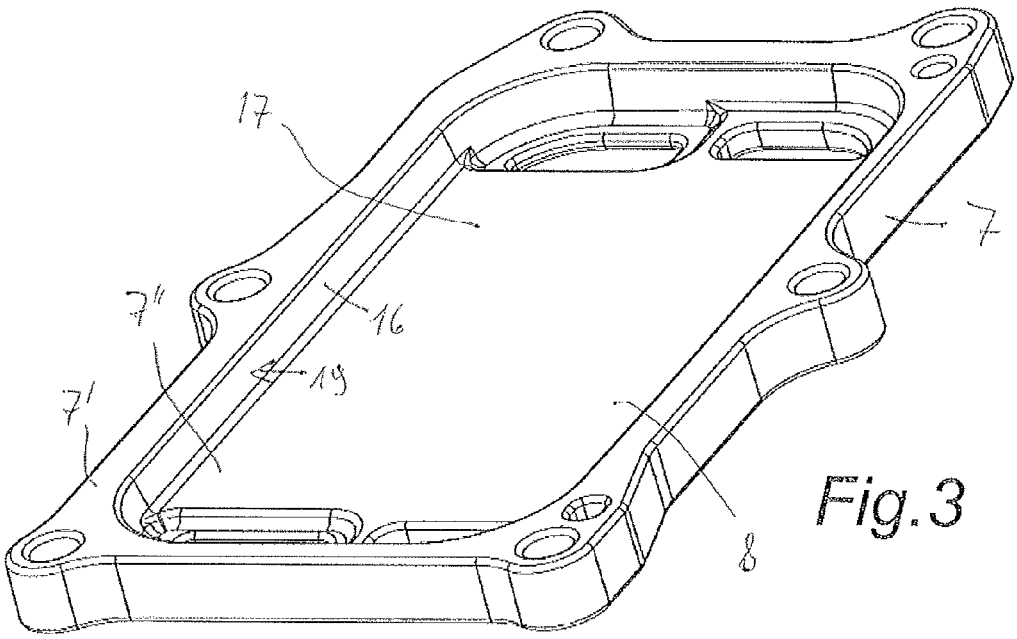
FIG. 3 shows an end plate of the said plate heat exchanger in an oblique view from above.
Figure 4:
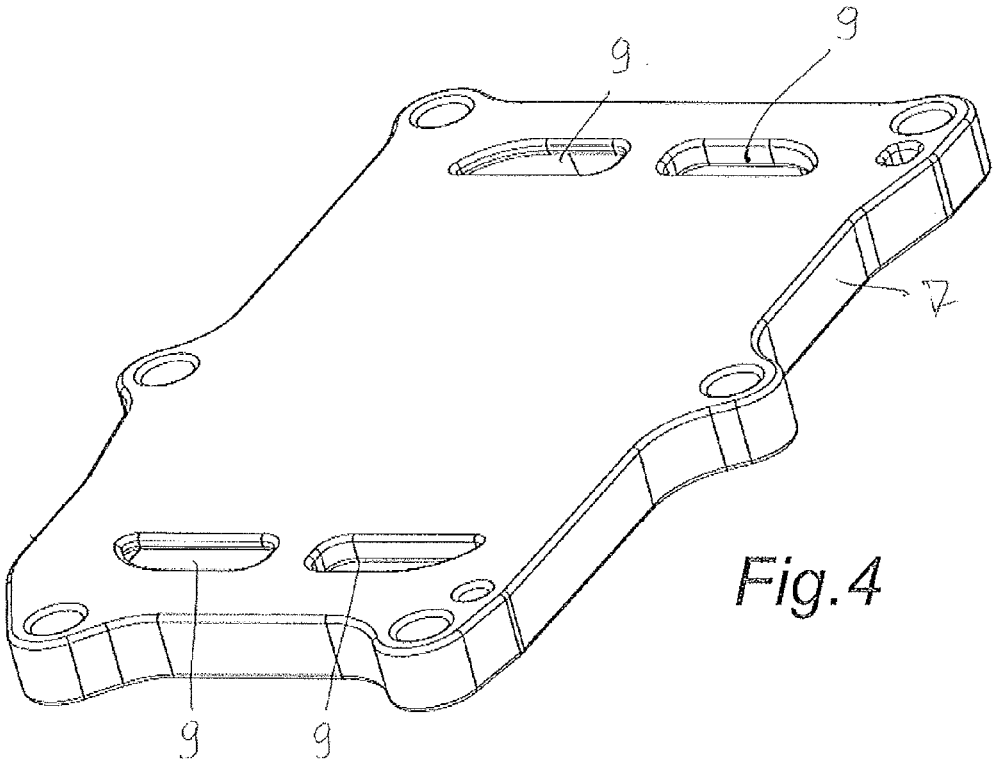
FIG. 4 shows the said end plate in an oblique view from below.
Figure 5:
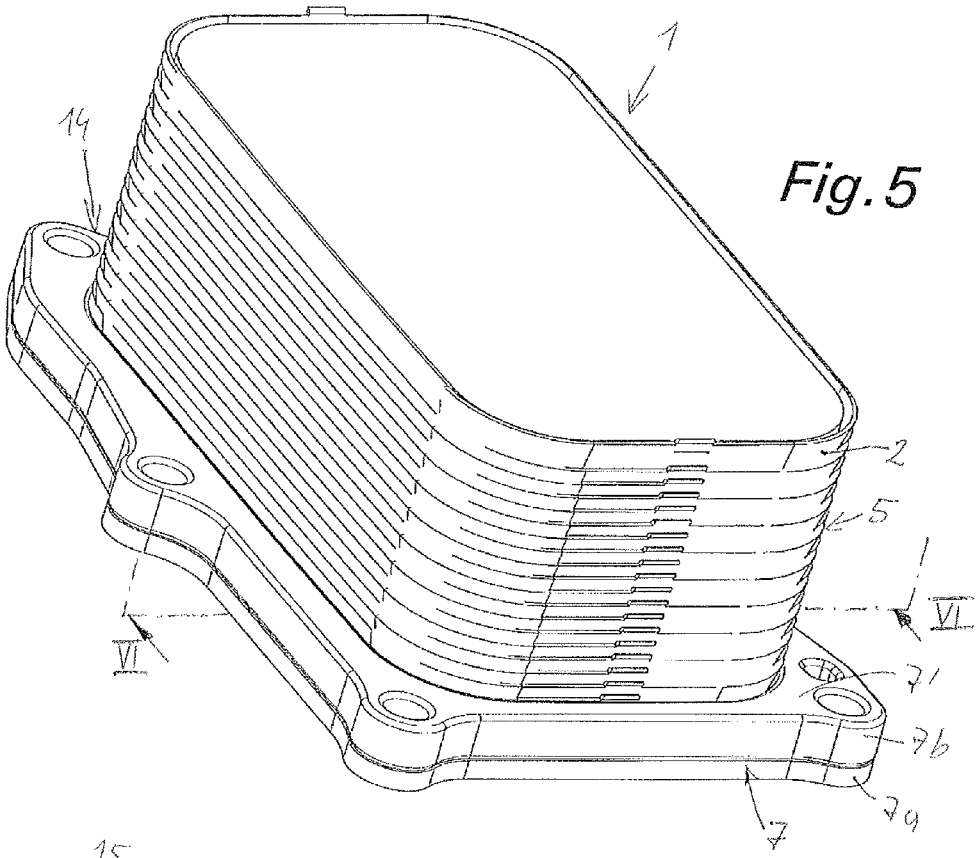
FIG. 5 shows a plate heat exchanger according to the invention in an oblique view in a second variant.
Figure 6:
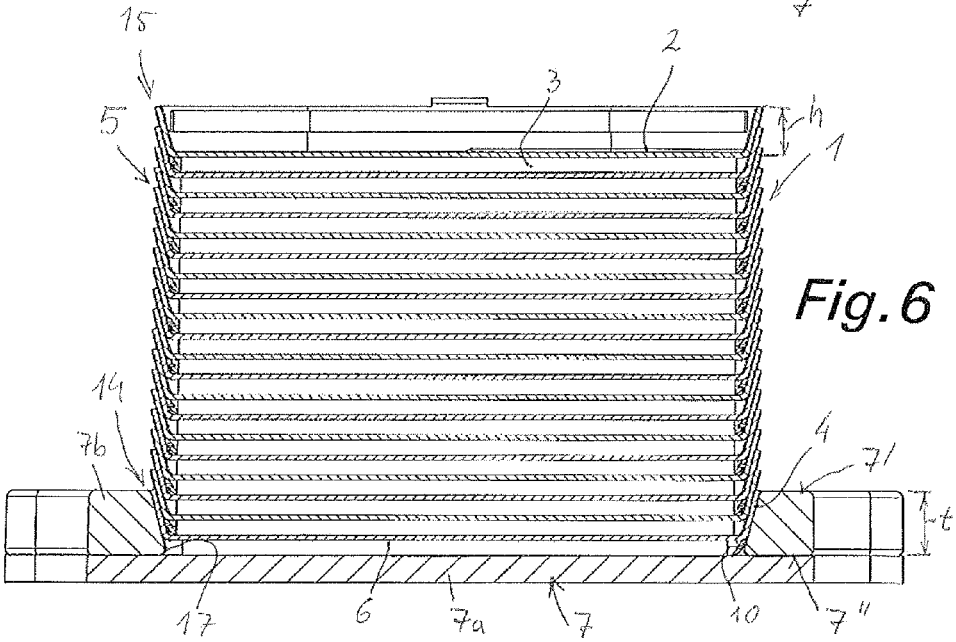
FIG. 6 shows the plate heat exchanger in section along line VI-VI in FIG. 5.
Figure 7:
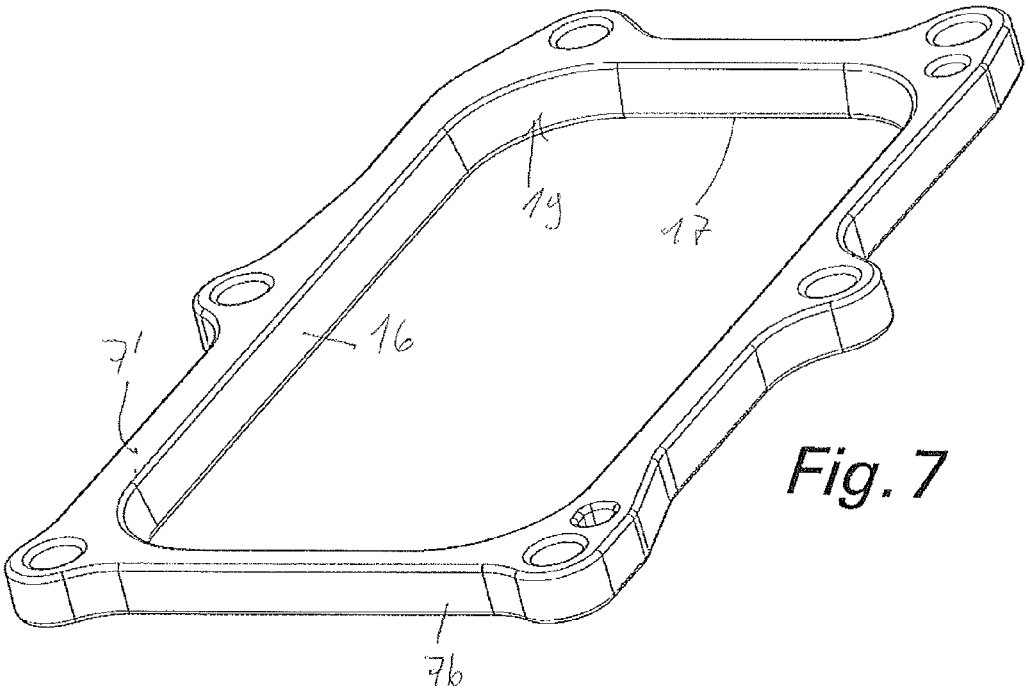
FIG. 7 shows a frame part of the said plate heat exchanger in an oblique view from above.
Figure 8:
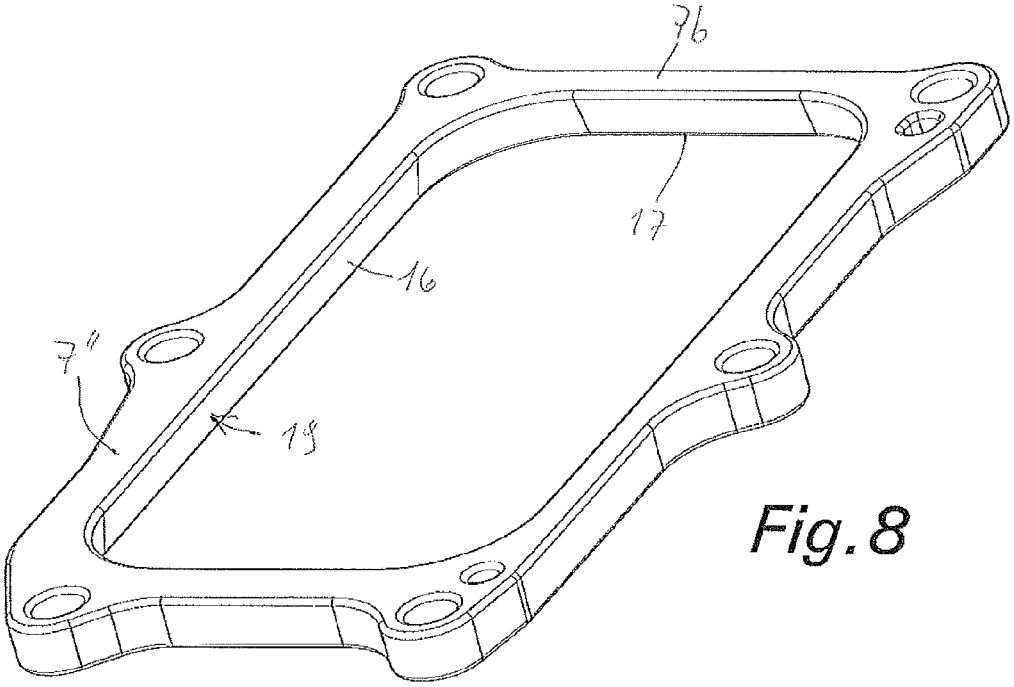
FIG. 8 shows the said frame part in an oblique view from below.
Figure 9:
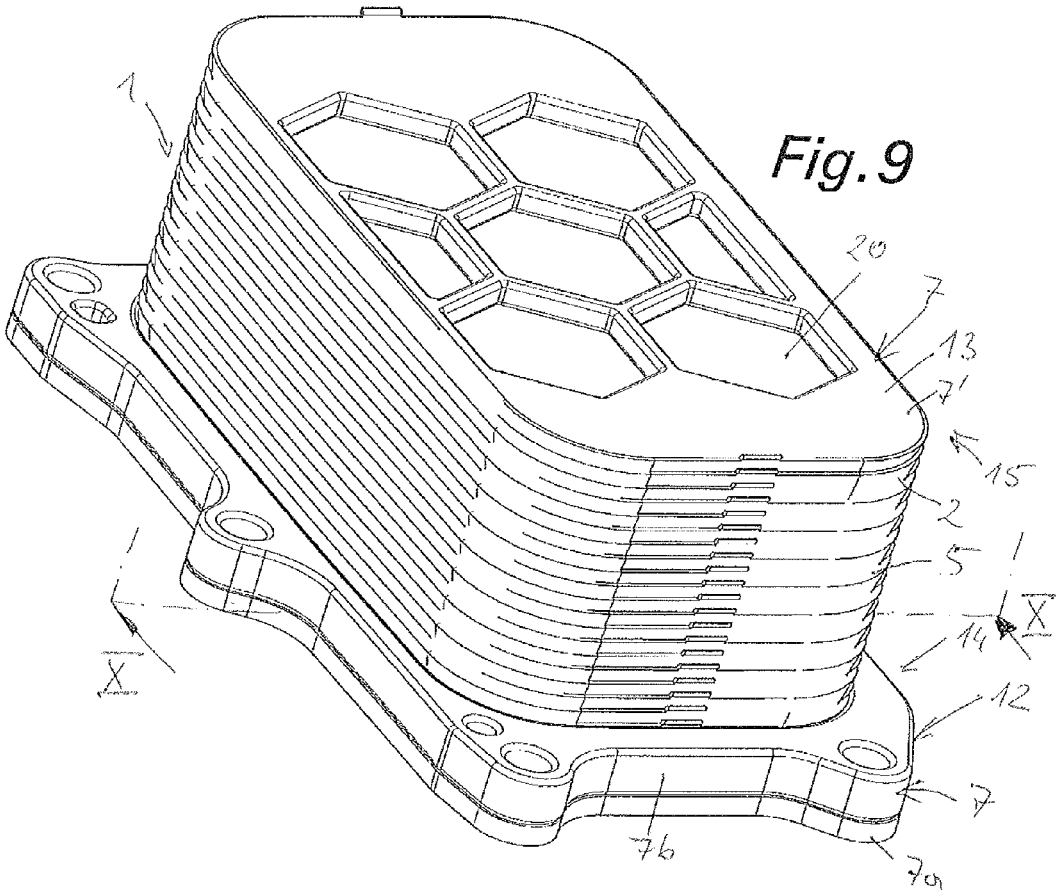
FIG. 9 shows a plate heat exchanger according to the invention in an oblique view in a third variant.
Figure 10:
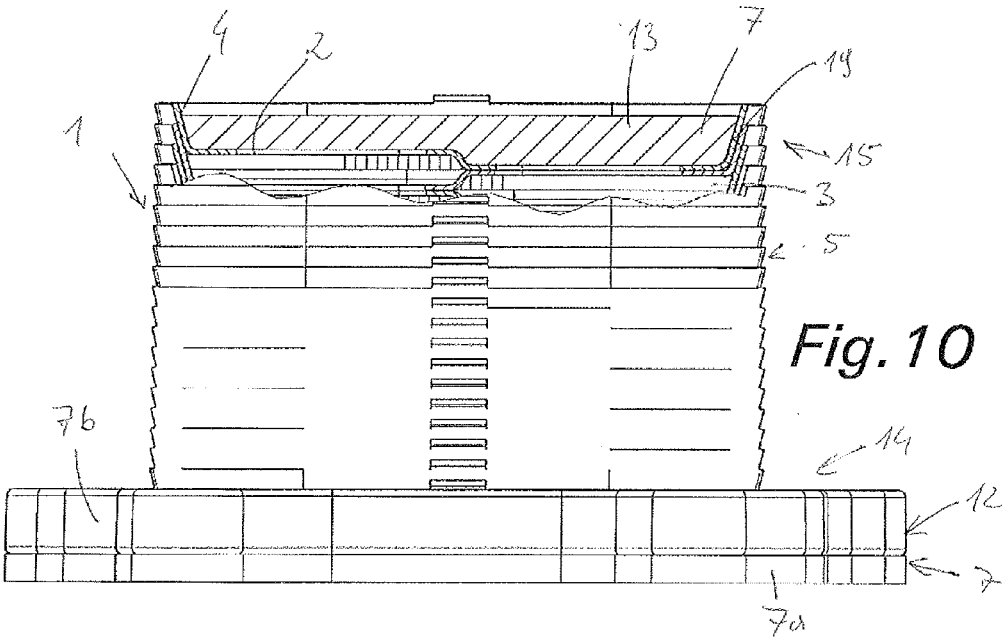
FIG. 10 shows the plate heat exchanger in section along line X-X in FIG. 9.
Figure 11:
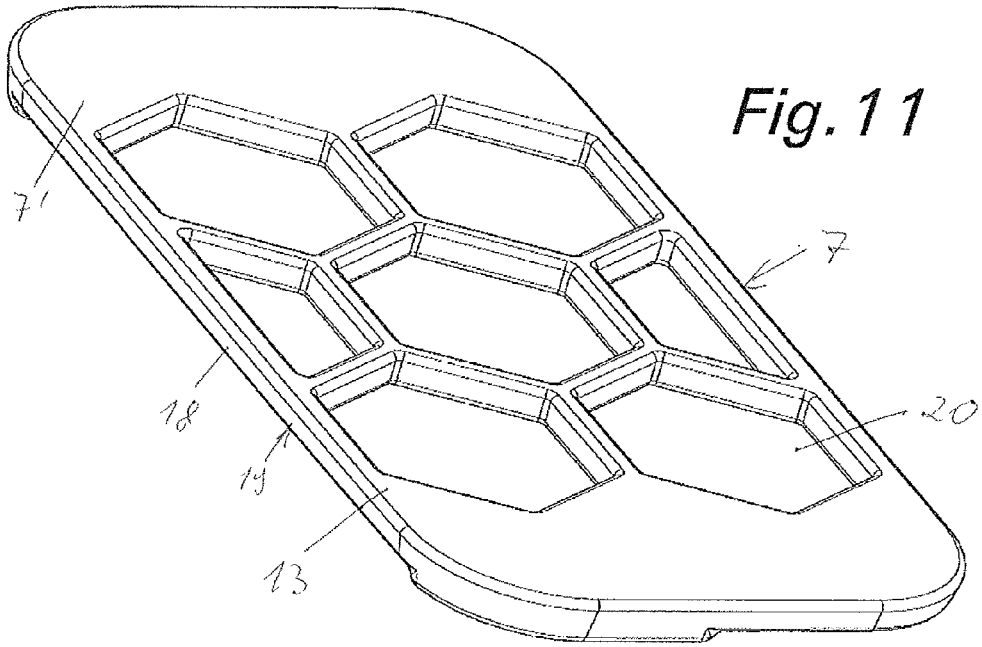
FIG. 11 shows an end plate of the said plate heat exchanger in an oblique view from above.
Figure 12:
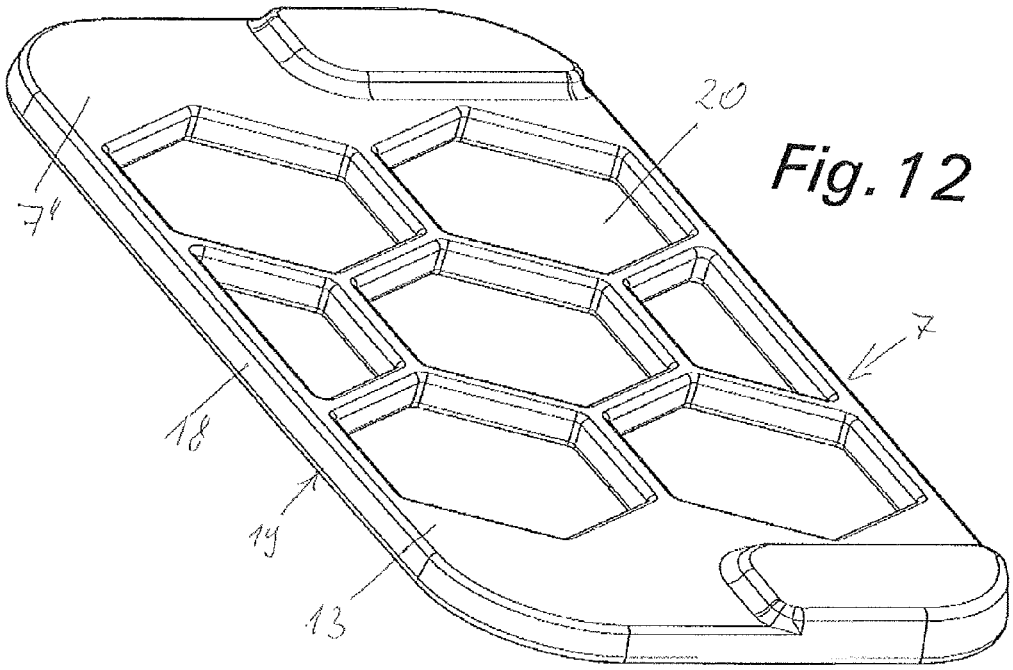
FIG. 12 shows the said end plate in an oblique view from below.

As can be seen in FIGS. 3 and 4, openings 9 for the feed or discharge of the cooling medium are formed in the end plate 7.

As the 3-dimensional shape of the end plate 7 with the receptacle cannot be produced using a conventional punched part, other production methods must be used. Suitable production methods for this are for instance:

- specific aluminium casting methods such as thixocasting or Vacural die casting, in which solderable alloys can be processed,
- shaping methods such as forging or extrusion,
- sintering methods, where applicable for suitable alloys,
- mechanical machining, if economically reasonable (for prototypes).

Thanks to the end plate 7 consisting of an aluminium alloy produced for example using the thixocasting method, the strength of the plate heat exchanger 1 can be increased sufficiently without essential disadvantages with respect to installation height and weight having to be accepted.

In the exemplary embodiment shown in FIGS. 5 to 8, the end plate 7 consists of an essentially flat plate part 7*a* formed from a punched part and a frame part 7*b* which is connected non-detachably to the latter, wherein the frame part 7*b* forms an additional reinforcement which encloses the heat exchanger block. The frame part 7*b* is formed with one of the above-mentioned manufacturing methods, so a similar body results as in FIGS. 1 to 4 of exemplary embodiment 1. The frame part 7*b* forms a receptacle 17 for the adjacent plate 2, wherein a wall face 19 formed by an inner lateral face 16 of the frame part 7*b* supports the edge 4 of the adjacent plate 2.

As the flat plate part 7*a* formed by a sheet metal plate can have a solder plating, it is possible to solder a turbulence insert 10 directly onto it. This saves one plate.

In the variants shown in FIGS. 1 to 8, the end plate 7 in each case forms a mounting plate 12 which has mounting openings 11.

In contrast, FIGS. 9 to 14 show plate heat exchangers 1 in which the end plate 7 forms a cover plate 13. Here there are similar advantages due to the full-area contact and the avoidance of notches by a 3-dimensionally shaped cover plate 13 instead of a conventional flat punched part. The cover plate 13 must likewise withstand oil pressure and vibration and load the rest of the plate structure of the plate heat exchanger 1 as little as possible. The edges 4 of the top plate 2 at the upper end 15 of the stack 5 are supported on the wall face 19 of the end plate 7 which is formed by an outer lateral face 18 and are connected fixedly to the said end plate by soldering. In order to save materials and weight without adversely affecting strength, the surface of the end plate 7 can be structured, for example in the form of a honeycomb 20.

Figure 13:
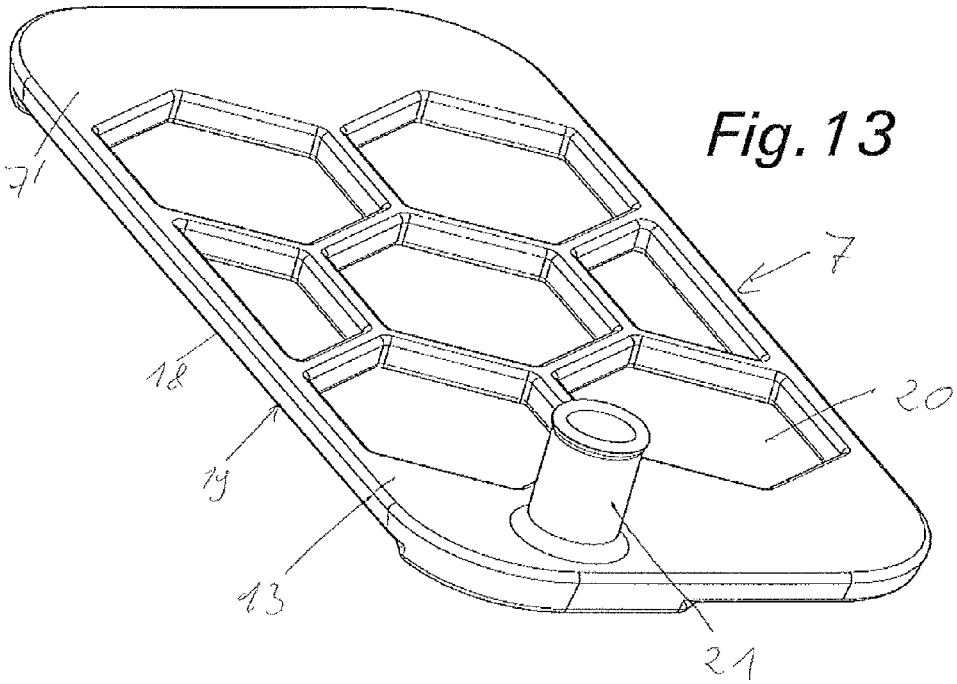
FIG. 13 shows the end plate of FIG. 11 in one variant in an oblique view from above and FIG. 14 shows the end plate in an oblique view from below.
Figure 14:
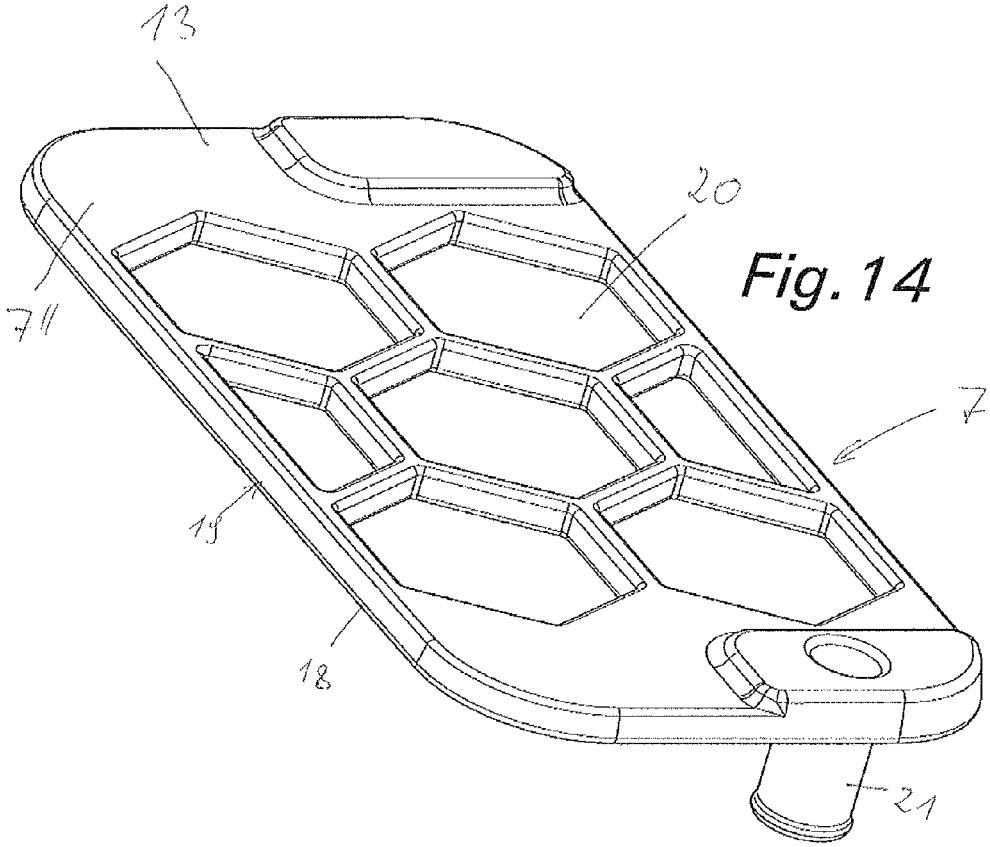

One or a plurality of connecting pieces 21 can optionally be integrated in the cover plate 13, which are preferably produced in the same manufacturing step as the end plate 7 itself, as is shown in FIGS. 13 and 14.

The invention claimed is:

1. A plate heat exchanger comprising: a plurality of plates stacked one upon the other forming a stack of plates, each of the plurality of plates alternately span a first and a second flow space for forming a first and second medium respectively, wherein each plate has a circumferential edge and a basin-shaped design, and wherein two adjacent plates are in each case connected to each other via the circumferential edges, an end plate fixedly connected to at least one adjacent plate at at least one end of the stack, wherein the circumferential edge of the at least one adjacent plate is supported on the end plate by a wall face of the end plate, the edge of the at least one adjacent plate is formed at least generally parallel to and is fixedly connected to the wall face, wherein the at least one adjacent plate is a lowest plate of the plurality of plates and is included in whole within a depression within the end plate, and the end plate includes an upper planar surface and a lower planar surface, and the depression therein is between the upper and the lower planar surfaces, and the end plate is defined to have a unitary thickness between the upper planar surface and a bottom of the depression, and the unitary thickness extends beyond the circumferential edges of the plates, wherein the end plate includes an aluminium alloy and the wall face is formed between two parallel surfaces of the end plate, wherein the two parallel surfaces include the upper planar surface and the lower planar surface;

further comprising a turbulence insert arranged between the at least one adjacent plate and the end plate.

2. The plate heat exchanger according to claim 1, wherein the wall face is formed by an inner lateral face of basin-like receptacle in the end plate for the adjacent plate.

3. The plate heat exchanger according to claim 2, wherein the end plate includes an essentially flat plate part and a frame part connected non-detachably to the plate part, wherein the receptacle is formed at least partially by the frame part.

4. The plate heat exchanger according to claim 2, wherein a depth of the receptacle corresponds essentially to at least a height of the edge of the plate.

5. The plate heat exchanger according to claim 1, wherein the wall face is at least partially formed by an outer lateral face of the end plate.

6. The plate heat exchanger according to claim 1, wherein the adjacent plate is in contact with at least a portion of the end plate with the face facing the end plate.

7. The plate heat exchanger according to claim 1, wherein the end plate is soldered to the adjacent plate.

8. The plate heat exchanger according to claim 1, wherein the end plate has at least one of at least one opening and at least one connecting piece for at least one of the feed and discharge of the respective medium.

9. The plate heat exchanger according to claim 1, wherein the end plate is produced using formed by an aluminium casting method using at least one of a thixocasting method and a Vacural die casting method.

10. The plate heat exchanger according to claim 1, wherein the end plate forms a mounting plate of the plate heat exchanger.

11. The plate heat exchanger according to claim 1, wherein the end plate forms a cover plate of the plate heat exchanger.

12. The plate heat exchanger according to claim 1, wherein the end plate has honeycomb-like structure defining at least one cut-out to reduce the weight.

13. The plate heat exchanger according to claim 2, wherein the adjacent plate is in contact with at least a portion of the end plate with the face facing the end plate.

14. The plate heat exchanger according to claim 2, wherein the end plate has at least one of at least one opening and at least one connecting piece for at least one of the feed and discharge of the respective medium.

15. The plate heat exchanger according to claim 2, wherein the end plate is formed by an aluminium casting method using at least one of a thixocasting method and a Vacural die casting method.

16. The plate heat exchanger according to claim 2, wherein the end plate forms a mounting plate of the plate heat exchanger.

17. The plate heat exchanger according to claim 1, wherein the end plate is attached to the lowest plate along an entire edge of the lowest plate.

18. A plate heat exchanger comprising:

a plurality of plates stacked one upon the other forming a stack of plates, each of the plurality of plates alternately span a first and a second flow space for forming a first and second medium respectively, wherein each plate has a circumferential edge and a basin-shaped design, and wherein two adjacent plates are in each case connected to each other via the circumferential edges, an end plate fixedly connected to at least one adjacent plate at at least one end of the stack, wherein the circumferential edge of the at least one adjacent plate is supported on the end plate by a wall face of the end plate, the edge of the at least one adjacent plate is formed at least generally parallel to and is fixedly connected to the wall face;

wherein the end plate includes an aluminium alloy and the wall face is formed between two parallel surfaces of the end plate;

wherein the wall face is formed by an inner lateral face of basin-like receptacle in the end plate for the adjacent plate;

wherein the receptacle is at least partially formed by a depression formed in the end plate and the at least one adjacent plate is included in whole within the depression, and the end plate includes an upper planar surface and a lower planar surface, and the depression therein is between the upper and the lower planar surfaces, wherein the two parallel surfaces include the upper planar surface and the lower planar surface, and the end plate extends having a unitary thickness from the upper planar surface to a bottom of the depression, and the unitary thickness extends beyond the circumferential edges of the plates, wherein the wall face is at least partially formed by an outer lateral face of the end plate;

further comprising a turbulence insert arranged between the at least one adjacent plate and the end plate;

wherein the at least one adjacent plate is in contact with the turbulence insert and attached thereto, and an outer surface of the at least one adjacent plate is in contact with an inner lateral face of the end plate.

* * * * *